United States Patent [19]

Dulmage et al.

[11] 4,148,640

[45] Apr. 10, 1979

[54] DEVELOPER COMPOSITIONS HAVING ELECTRICALLY CONDUCTING FILAMENTS IN CARRIER PARTICLE MATRIX

[75] Inventors: William J. Dulmage; Alfred E. Fields, both of Rochester, N.Y.

[73] Assignee: Eastman Kodak Company, Rochester, N.Y.

[21] Appl. No.: 450,028

[22] Filed: Mar. 11, 1974

[51] Int. Cl.[2] ..... G03G 13/08; G03G 9/10

[52] U.S. Cl. ..... 96/1 SD; 252/62.1 P

[58] Field of Search ..... 252/501, 62.1 P; 96/1 SD, 1 R

[56] References Cited

U.S. PATENT DOCUMENTS

| | | | |
|---|---|---|---|
| 2,965,573 | 12/1960 | Gundlach | 96/1 SD |
| 3,639,245 | 2/1972 | Nelson | 252/62.1 |
| 3,752,666 | 8/1973 | Hagenbach et al. | 96/1 SD |
| 3,839,029 | 10/1974 | Berg et al. | 96/1 SD |

*Primary Examiner*—Roland E. Martin, Jr.
*Assistant Examiner*—John L. Goodrow
*Attorney, Agent, or Firm*—Arthur H. Rosenstein

[57] ABSTRACT

An electrographic developer contains a mixture of toner powder particles and carrier particles comprising tendrillar electrically conducting filaments substantially uniformly distributed in a matrix, said filaments, matrix and toner particles being triboelectrically balanced. Improved electrographic toner images are achieved by the use of the dry developers.

20 Claims, No Drawings

DEVELOPER COMPOSITIONS HAVING ELECTRICALLY CONDUCTING FILAMENTS IN CARRIER PARTICLE MATRIX

This invention relates to the development of electrostatic latent images.

Electrographic imaging and developing processes, e.g. electrophotographic imaging processes and techniques, have been extensively described in both the patent and other literature, for example, U.S. Pat. Nos. 2,221,776 issued Nov. 19, 1940; 2,277,013 issued Mar. 17, 1942; 2,297,691 issued Oct. 6, 1942; 2,357,809 issued Sept. 12, 1944; 2,551,582 issued May 8, 1951; 2,825,814 issued Mar. 4, 1958; 2,833,648 issued May 6, 1958; 3,220,324 issued Nov. 30, 1965; 3,220,831 issued Nov. 30, 1965; 3,220,833 issued Nov. 30, 1965 and many others.

Electrophotographic processes, for example, employ electrophotographic or photoconductive elements typically comprising a coating of a photoconductive insulating material on a conductive support. The element is given a uniform surface charge in the dark and then exposed to an image pattern of activating electromagnetic radiation such as light or x-rays. The charge on the photoconductive element is dissipated in the illuminated area to form an electrostatic charge pattern which is then developed by contact with an electroscopic marking material. The marking material or toner as it is also called, whether carried in an insulating liquid or in the form of a dry powder deposits on the exposed surface in accordance with either the charge pattern or a discharge pattern as desired. Then, if the photoconductive element is of the non-reusable type, the developed image is fixed by fusion or other means to the surface of the photoconductive element. If the element is of the reusable type, the image is transferred to another surface such as paper and then fixed to provide a copy of the original.

A variety of electrophotographic developing compositions are available for use in developing electrostatic charge patterns. The developers generally comprise a carrier vehicle and marking particles (toner particles). The carrier serves as a medium for carrying the electrostatically responsive toner particles to the charge pattern to be developed. The use of dry developers for this purpose is well known in the art. Typical dry developers comprise electrostatically responsive toner particles and a particulate carrier. The carrier and toner particles are applied by the well known magnetic brush process or other suitable methods.

The use of dry carrier and toners, however, have presented some problems in that large solid areas may not be fully developed and a "halo" effect frequently develops in the image. U.S. Pat. No. 2,919,247 describes the addition of electrically conductive powder to lessen the "halo" effect. U.S. Pat. No. 2,965,573 describes an improved method of adding electrically conductive filaments to the toner and carrier particles. These filaments are cascaded over the image areas with the toners and carriers.

In U.S. Pat. No. 3,533,835 there is described a dry developer for electrostatic images comprising toner particles and carrier particles wherein the carrier particles contain a conductive material in the carrier matrix generally by coating the carrier matrix core with a conductive particulate material.

The problems involved in the prior art conductive carriers are numerous. For example, in magnetic brush development, if the carrier particles are too conductive and the magnetic brush used to apply them is grounded, the electrostatic charge pattern rapidly dissipates. On the other hand, increasing the magnetic brush bias tends to cause carrier particle pickup which results in decreased image quality.

The term "carrier pick-up" is used herein to describe the undesirable attraction of carrier particles to the electrostatic image bearing electrographic element which occurs when the attractive force between the carrier and the element is greater than the magnetic attractive force between the carrier particles and the magnetic brush. Low carrier pickup indicates that few or no particles are present per image frame of the electrographic element. High carrier pickup means that many particles are present per image frame of the electrographic element.

More importantly, the carrier particles of the invention are designed for reuse. Thus, they are recycled after the original image development and reused with fresh toner to affect subsequent developments. The process is repeated for each copy produced and is ordinarily repeated many thousands of times during the life of the developer mixture. In these development techniques, the developer mixture is subjected to a great deal of mechanical attrition which tends to degrade the carrier particles. This degradation occurs primarily as a result of sheer and impact forces due to the tumbling of the developer mixture on the image-bearing photoconductor and the falling back of the carrier particles to be recycled. The deterioration of the carrier particles is characterized by the separation of portions of the carrier in the form of chips, flakes, etc. The carriers which are chipped must be replaced incurring added expense and time. When the damaged particles are not replaced, print deletion and poor print quality occurs as the proper triboelectric balance cannot be maintained.

Accordingly, there is a need in the art for dry developer compositions which produce improved fine line and semi-solid reproduction with little carrier pickup, which is simple to formulate, and which comprises carrier particles which may be chipped or fractured and still maintain a stable toner carrier triboelectric relationship.

It is, therefore, an object of this invention to provide novel compositions for the dry development of electrostatic charge patterns.

It is another object of this invention to provide new dry developer compositions which maintain a stable toner carrier triboelectric relationship when chipped or fractured.

It is yet another object of this invention to provide a process for the development of electrostatic charge patterns using the novel dry developer compositions of this invention.

These and other objects and advantages are accomplished in accordance with this invention by the preparation and use of dry developer compositions comprising a mixture of toner powder particles and carrier particles containing a matrix and wherein said matrix has uniformly distributed therein tendrillar electrically conducting filaments extending at least through the surface of said carrier particles, said matrix and filaments being triboelectrically different from said toner particles and said matrix and filaments having a triboelectric relationship of like polarity with respect to said toner powder particles and said filaments having a substantially neutral triboelectric relationship with respect to said matrix.

The carrier particles comprise a matrix of granular non-metallic particles, said particles having uniformly distributed therein tendrillar electrically conducting filaments extending at least through the surface of said particles, said matrix and filaments being triboelectrically different from said toner powder particles and said matrix and filaments having a triboelectric relationship of like polarity with respect to the toner powder particles and said filaments having a substantially neutral triboelectric relationship with respect to said matrix.

The matrix material of the carrier particles may be any non-metallic material which possesses sufficient difference in triboelectric properties from the toner grains and adheres to the tendrillar filaments. Generally the matrix may be glass or a film-forming binder which is preferably a natural or thermoplastic or thermosetting resin or a mixture of such resins having appropriate mechanical and triboelectric properties. Appropriate monomers (which can be used to prepare resins for this use) include for example, vinyl monomers, such as alkyl acrylates and methacrylates, styrene and substituted styrenes, and vinyl pyridines. Copolymers prepared with these and other vinyl monomers, such as acidic monomers, e.g., acrylic or methacrylic acid can be used. Such copolymers can advantageously contain small amounts of polyfunctional monomers, such as divinylbenzene, glycol dimethacrylate and triallyl citrate. It is preferred that the matrix material be either semiconductive or electrically insulating and have a volume resistivity of more than about $10^{10}$ ohm centimeters. A particularly preferred matrix material comprises fluorocarbons such as poly(tetrafluoroethylene), poly(vinylidene fluoride), and mixtures thereof including poly(vinylidene-fluoride-co-tetrafluoroethylene).

Although the carrier particles may be virtually any size, in the preferred embodiment, the matrix particle sizes are from about 250 to about 1000 microns.

Tendrillar electrically conducting filaments are uniformly distributed throughout the matrix. The filaments have a neutral triboelectric relationship with the matrix and are triboelectrically different from the toner powder particles. The filaments may consist of any conductive or semiconductive flexible fibrous material having an electrical resistivity of about $10^{10}$ ohm-cm or less. Thus, the filaments can be conductive carbon fibers or metals such as iron, steel, stainless steel, nickel, cobalt, or mixtures of ferromagnetic metals and non-ferromagnetic metals such as copper, aluminum, silver, etc, and the like; metal filled materials such as metal filled natural and synthetic polymers; and amorphous materials such as glass and the like; and non-conductive fibrous material coated or plated with conductive materials such as iron, nickel, or cobalt-plated natural or synthetic polymers and the like. The preferred filaments are stainless steel filaments.

The filaments typically are of any size and length, but the preferred filaments have a diameter of from 4 to 24 microns and a length in the range of 250 to 3500 microns.

The filaments must be uniformly distributed throughout the matrix. Thus, the filaments touch adjacent filaments thereby insuring an excellent particle-to-particle conductivity. The tendrillar filaments extend at least through the surface of the matrix. The filaments generally extend about 0.5 to about 2500 microns from the surface of the matrix.

The size of the carrier particles is generally in the range of about 250 to 1000 microns although smaller and larger particles may be used depending on the size and shape of the conductive filaments. The filaments comprise from about 40% to about 90% by weight of the carrier particles.

The carrier particles are prepared by a number of known methods, for example, the matrix and the filaments may be mixed in solutions with solvents such as in acetone, benzene, chloroform, dimethylformamide or the like or may be melt-mixed as long as the filamentary material is not melted or dissolved thereby. The preferred method is to simply dissolve the matrix in a solvent such as acetone and add the filaments and remove the solvent by drying. After the filaments and matrix are mixed they are mill ground and screened to the desired particle size range.

The toner used for the carrier particles containing the tendrillar filaments of this invention can be selected from a wide variety of materials to give desired physical properties to the developed image and the proper triboelectric relationship to match the carrier particles used. Generally, any of the toner powders known in the art are suitable for mixing with the carrier particles of this invention to form a developer composition. When the toner powder selected is utilized with ferromagnetic carrier particles in a magnetic-brush development arrangement, the toner clings to the carrier by triboelectric attraction. The carrier particles acquire a charge of one polarity and the toner acquires a charge of the opposite polarity. Thus, if the carrier is mixed with a resin toner which is higher in the triboelectric series, the toner normally acquires a positive charge and the carrier a negative charge.

Toner powders suitable for use in this invention are typically prepared by finely grinding a resinous material and mixing with a coloring material such as a pigment or a dye. The mixture is then ball milled for several hours and heated so that the resin flows and encases the colorant. The mass is cooled, broken into small chunks and finely ground again. After this procedure, the toner powder particles usually range in size from about 0.5 to about 25 microns, with an average size of about 2 to about 15 microns.

The resin material used in preparing the toner can be selected from a wide variety of materials, including natural resins, modified natural resins and synthetic resins. Exemplary of useful natural resins are balsam resins, colophony and shellac. Exemplary of suitable modified natural resins are colophony-modified phenol resins and other resins listed below with a large proportion of colophony. Suitable synthetic resins are all synthetic resins known to be useful for toner purposes, for example, polymers, such as vinyl polymers including polyvinylchloride, polyvinylidene chloride, polyvinyl acetate, polyvinyl acetals, polyvinyl ether and polyacrylic and polymethacrylic esters; polystyrene and substituted polystyrenes or polycondensates, e.g., polyesters such as phthalate resin, terephthalic and isophthalic polyesters, maleinate resin and colophony-mixed esters of higher alcohols; phenol formaldehyde resins, including colophony-modified phenol formaldehyde condensates, aldehyde resins, ketone resins, polyamides and polyadducts, e.g., polyurethanes. Moreover, polyolefins, such as various polyethylenes, polypropylenes, polyisobutylenes and chlorinated rubber are suitable. Additional toner materials which are useful are disclosed in the following U.S. Pat. Nos.: 2,917,460; Re. 25,136; 2,788,288; 2,638,416; 2,618,551 and 2,659,670.

The coloring material additives useful in suitable toners are preferably dyestuffs and colored pigments. These materials serve to color the toner and thus render it more visible. In addition, they sometimes affect, in known manner, the polarity of the toner. In principle, virtually all of the compounds mentioned in the Color Index, Vol. I and II, Second Edition, 1956, can be used as colorants. Included among the vast number of suitable colorants would be such materials as Nigrosin Spirit solution (C.I. 50415), Hansa Yellow G (C.I. 11680), Chromogen Black ETOO (C.I. 14645), Rhodamine B (C.I. 45170), Solvent Black 3 (C.I. 26150), Fuchsine N (C.I. 42510), C.I. Basic Blue 9 (C.I. 52015), etc.

The carrier particles with the filaments and toner particles are mixed together and applied to the electrostatic image to develop the said image. The developer compositions generally comprise from about 90 to about 99% by weight of carrier particles and from about 1 to about 10% by weight of the toner particles.

Although the developer may be applied by other means such as by the well known cascade method, in the preferred embodiment the dry developer is applied by the "magnetic brush" process as disclosed for example in U.S. Pat. No. 2,874,063. In this method, a developer material containing toner and magnetic carrier particles is carried by a magnet. The magnetic field of the magnet causes alignment of the magnetic carriers in a brush-like configuration. This "magnetic brush" is engaged with an electrostatic image-bearing surface and the toner particles are drawn from the brush to the electrostatic image by electrostatic attraction. Many other methods such as "touchdown" development as disclosed by C. R. Mayo in U.S. Pat. No. 2,895,847 are known for applying electroscopic particles to the latent electrostatic image to be developed. The development processes as mentioned above together with numerous variations are well known to the art through various patents and publications and through the widespread availability and utilization of electrostatographic imaging equipment.

A further aspect of the preparation of developers for multiple use involves replenishment. In such processes, it is desirable that the composition of the developer remain essentially constant with use and that the reproduction quality of many successive transferred images is not affected by such use. To prevent change in transfer reproduction characteristics, the developer components removed must be replenished at regular intervals. If the various components, such as binder, pigment, etc., deposit on the image in such proportions that they can be satisfactorily replenished in the remaining developer, the developer is considered to have good replenishment characteristics for the purposes of this invention. If, however, they deposit on the image in such proportions that they cannot be replenished totally, the developer is considered to have poor replenishment characteristics.

The dry developers of this invention have excellent replenishment characteristics due to the constant triboelectric relationship of the carrier, even when chipped, to the toner.

The following examples are included for a further understanding of the invention.

EXAMPLE 1

Carrier particles were prepared by dissolving 144 g of poly(vinylidene chloride-co-tetrafluoroethylene)[Kynar 7201] in 751 ml of acetone and adding 422 g of stainless steel filaments having diameters of 8$\mu$ and lengths of 0.03". The composition was mixed with mechanical agitation and the solvent was removed from the formulation by drying at room temperature in crystallizing trays. The mixture was heated at 130° C. for 2 hours. After cooling, the material was ground in a Wiley mill equipped with a 1 mm screen. The carrier was separated with a 60 mesh screen which retained particles larger than 250 microns.

A developer composition was prepared by mixing 70 g. of a toner comprising a pigmented thermoplastic resin with 350 g. of the above carrier particles.

EXAMPLE 2

The developer of Example 1 was applied to an electrostatic image containing photoconductive element in a magnetic brush development apparatus. The apparatus comprises a cylindrical aluminum tube arranged to rotate axially in a horizontal position about a fixed permanent magnet. The permanent magnet has its poles oriented such that when the magnetic particles are present a magnetic brush is formed on top of the cylinder. The apparatus was run with the magnetic brush in contact with an electrophotographic element comprised of a conductive support coated with an imagewise charged photoconductive layer. The prints obtained had excellent fine-line and semi-solid characteristics and there was no noticeable carrier pick-up evident on the prints.

The carrier particles after many prints will exhibit essentially the same triboelectric relationship to the toner particles as they did prior to the first use. Developer compositions wherein the carrier particles are coated with a conductive layer and developer compositions containing carrier particles, toner particles and separate fibrous particles after repeated use tend to exhibit unstable toner carrier triboelectric relationships.

The invention has been described in detail with particular reference to certain preferred embodiments thereof, but it will be understood that variations and modifications can be effected within the spirit and scope of the invention.

We claim:

1. A dry developer for developing electrostatic charge patterns comprising a mixture of toner powder particles and non-metallic carrier particles, each of said carrier particles comprising a matrix having substantially uniformly distributed therein tendrillar electrically conducting filaments extending at least through the surface of said particles, said matrix and filaments being triboelectrically different from said toner powder particles and said matrix and filaments having a triboelectric relationship of like polarity with respect to said toner powder particles.

2. The developer of claim 1 wherein the filaments have a volume resistivity less than about $10^{10}$ ohm-cm.

3. The developer of claim 1 wherein the filaments are flexible materials having a diameter of from 4 to 24 microns and a length in the range of 250 to 3500 microns.

4. The developer of claim 1 wherein the filaments are stainless steel.

5. The developer of claim 1 wherein the matrix is a synthetic polymer.

6. The developer of claim 5 wherein the matrix is poly(vinylidene fluoride-co-tetrafluoroethylene).

7. The developer of claim 1 wherein the matrix particle size is from about 250 to 1000 microns.

8. The developer of claim 1 wherein the filaments comprise from 40 to 90% by weight of the total weight of matrix and filament.

9. The developer of claim 1 wherein the matrix is glass.

10. The developer of claim 1 wherein the matrix has a volume resistivity more than about $10^{10}$ ohm-cm.

11. The developer of claim 1 wherein the filaments are non-conductive with a continuous outer coating of a conductive material.

12. A dry developer for developing electrostatic charge patterns comprising a mixture of toner powder particles and non-metallic carrier particles having a particle size of from 250 to 1000 microns and a volume resistivity more than about $10^{10}$ ohm-cm, each of said particles containing a matrix having uniformly distributed therein tendrillar filaments having a volume resistivity less than about $10^{10}$ ohm-cm, and a diameter of from 4 to 24 microns and a length in the range of 250 to 3500 microns, and wherein the filaments comprise from 40 to 90% by weight of the matrix and filament, said filaments extending at least to the surface of said particles, said matrix and filaments being triboelectrically different from said toner powder particles, and said matrix and filaments having a triboelectric relationship of like polarity with respect to said toner powder particles.

13. A dry developer for developing electrostatic charge patterns comprising a mixture of toner powder particles in the size range of from about 0.5 to about 250 microns and polymeric carrier particles having a particle size of from 250 to 1000 microns and a volume resistivity more than about $10^{10}$ ohm-cm, each of said particles containing a matrix having uniformly distributed therein tendrillar stainless steel filaments having a volume resistivity less than about $10^{10}$ ohm-cm and a diameter of from 4 to 24 microns and a length in the range of 250 to 3500 microns and wherein the filaments comprise from 40 to 90% by weight of the matrix and filaments, said filaments extending at least to the surface of said particles, said matrix and filaments being triboelectrically different from said toner powder particles, and said matrix and filaments having a triboelectric relationship of like polarity with respect to said toner powder particles.

14. An electrophotographic process which comprises forming an electrostatic image on a photoconductor and developing the image with a dry developer comprising a mixture of toner powder particles and non-metallic carrier particles, each of said carrier particles containing a matrix having uniformly distributed therein tendrillar electrically conductive filaments extending at least through the surface of said particles, said matrix and filaments being triboelectrically different from said toner powder particles, and said matrix and filaments having a triboelectric relationship of like polarity with respect to said toner powder particles.

15. The electophotographic process of claim 14 wherein the filaments have a volume resistivity less than about $10^{10}$ ohm-cm.

16. The electrophotographic process of claim 14 wherein the filaments are a flexible material having a diameter of from 4 to 24 microns and a length in the range of from 250 to 3500 microns.

17. The electrophotographic process of claim 14 wherein the matrix particle size is from about 250 to about 1000 microns.

18. The electrophotographic process of claim 14 wherein the filaments comprise from 40 to 90% by weight of the total weight of matrix and filament.

19. The electrophotographic process of claim 14 wherein the matrix has a volume resistivity more than about $10^{10}$ ohm-cm.

20. An electrophotographic process which comprises forming an electrostatic image on a photoconductor and developing the image with a dry developer comprising a mixture of toner powder particles and non-metallic carrier particles having a particle size of from 250 to 1000 microns and a volume resistivity more than about $10^{10}$ ohm-cm, each of said particles containing a matrix having uniformly distributed therein tendrillar filaments having a volume resistivity less than about $10^{10}$ ohm-cm and a diameter of from 4 to 24 microns and a length in the range of 250 to 3500 microns and wherein the filaments comprise from 40 to 90% by weight of the matrix and filament, said filaments extending at least to the surface of said particles, said matrix and filaments being triboelectrically different from said toner powder particles and said matrix and filaments having a triboelectric relationship of like polarity with respect to said toner powder particles.

* * * * *